US009608333B1

(12) United States Patent
Toledo et al.

(10) Patent No.: US 9,608,333 B1
(45) Date of Patent: Mar. 28, 2017

(54) SCALABLE HIGH COMPACTION RATIO MESH HOOP COLUMN DEPLOYABLE REFLECTOR SYSTEM

(71) Applicant: HARRIS CORPORATION, Melbourne, FL (US)

(72) Inventors: Gustavo A. Toledo, Rockledge, FL (US); Dana Monnier, Palm Bay, FL (US); Jessica Beahn, Malabar, FL (US); Michael R. Winters, West Melbourne, FL (US); Ryan Whitney, Indialantic, FL (US); Robert M. Taylor, Rockledge, FL (US); Jonathan Boyles, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 14/961,062

(22) Filed: Dec. 7, 2015

(51) Int. Cl.

| | |
|---|---|
| ***H01Q 15/14*** | (2006.01) |
| ***H01Q 15/20*** | (2006.01) |
| ***H01Q 15/16*** | (2006.01) |
| ***H01Q 1/36*** | (2006.01) |
| ***H01Q 1/12*** | (2006.01) |

(52) U.S. Cl.
CPC ..... *H01Q 15/161* (2013.01); *H01Q 1/1242* (2013.01); *H01Q 1/36* (2013.01)

(58) Field of Classification Search
CPC ..... H01Q 15/161; H01Q 15/14; H01Q 15/20; H01Q 1/288
See application file for complete search history.

(56) References Cited

U.S. PATENT DOCUMENTS

| | | | | |
|---|---|---|---|---|
| 3,508,270 A | | 4/1970 | Cook | |
| 3,739,538 A | | 6/1973 | Rubin | |
| 3,780,375 A | | 12/1973 | Cummings et al. | |
| 5,864,324 A | * | 1/1999 | Acker | H01Q 15/168 343/912 |
| 6,225,965 B1 | * | 5/2001 | Gilger | H01Q 1/288 343/912 |

(Continued)

OTHER PUBLICATIONS

Sullivan, Marvin R., LSST (Hoop/Column) Maypole Antenna Development Program, NASA Contractor Report 3558; NASA-CR-3558-PT-1 19820018481; Contract NAS1-15763, Jun. 1982, Parts 1 and 2.

*Primary Examiner* — Hoang Nguyen
(74) *Attorney, Agent, or Firm* — Fox Rothschild LLP; Robert J. Sacco; Carol E. Thorstad-Forsyth

(57) ABSTRACT

A reflector system includes a hoop assembly, a collapsible mesh reflector surface and an extendible mast assembly. The hoop assembly includes a plurality of link members extending between a plurality of hinge members and the hoop assembly is moveable between a collapsed configuration wherein the link members extend substantially parallel to one another and an expanded configuration wherein the link members define a circumferential hoop. The reflector surface is secured to the hoop assembly and collapses and extends therewith. The hoop is secured by cords relative to top and bottom portions of a mast that maintains the hoop substantially in a plane. The mast is stored on a spool and extends to release the hoop, pull the mesh reflector surface into a shape that is intended to concentrate RF energy in a desired pattern, and tension the cords that locate the hoop.

31 Claims, 16 Drawing Sheets

(56) References Cited

U.S. PATENT DOCUMENTS

| | | | | |
|---|---|---|---|---|
| 6,278,416 | B1 * | 8/2001 | Harless | F24J 2/125 343/840 |
| 7,337,097 | B2 * | 2/2008 | Ih | G06F 17/5009 244/171 |
| 9,496,621 | B2 * | 11/2016 | Meschini | B64G 1/222 |

* cited by examiner

SCALABLE HIGH COMPACTION RATIO MESH HOOP COLUMN DEPLOYABLE REFLECTOR SYSTEM

FIELD OF THE INVENTION

The inventive arrangements relate to compact antenna system structures, and more particularly, to a compact deployable antenna reflector structure.

BACKGROUND OF THE INVENTION

Various conventional antenna structures exist that include a reflector for directing energy into a desired pattern. One such conventional antenna structure is a radial rib reflector design comprising a plurality of reflector ribs joined together at a common cylindrical shaped hub. The reflector ribs provide structural support to a flexible antenna reflector surface attached thereto. A plurality of cords, wires, guidelines, or other tensile members couple the flexible antenna reflector surface to the reflector ribs. The wires or guidelines define and maintain the shape of the flexible antenna reflector surface. The radial rib reflector is collapsible so that it can be transitioned from a deployed position to a stowed position. In the deployed position, the radial rib reflector has a generally parabolic shape. In the stowed position, the reflector ribs are folded up against each other. As a result, the antenna reflector has a stowed height approximately equal to the reflector's radius.

Another conventional antenna structure is a folding rib reflector having a similar design to the radial rib reflector design described above. However, the reflector ribs include a first rib shaft and second rib shaft joined together by a common joint. In the stowed position, the first rib shafts are folded up against the second rib shafts. As such, the antenna reflector has a stowed height that is less than the stowed height of the radial rib reflector design. However, the stowed diameter of the folding rib reflector is larger than the stowed diameter of the radial rib reflector design.

In each of the previous designs, the aperture of the reflector is directly related to the length of the ribs, such that any increase in aperture size requires a directly corresponding increase in rib size and thereby an increased package volume.

Another type of configuration is a hoop reflector where the reflector surface is attached to a circular hoop. To shape the reflector into a parabolic surface, the hoop must have thickness out of the plane of the hoop that is greater than the depth of the parabolic surface. The hoop also must have bending stiffness to prevent the attachments to the reflector from warping out of a plane.

SUMMARY OF THE INVENTION

In at least one embodiment, the invention provides a reflector system including a hoop assembly, a collapsible mesh reflector surface and an extendible mast assembly. The hoop assembly includes a plurality of link members extending between a plurality of hinge members and the hoop assembly is moveable between a collapsed configuration wherein the link members extend substantially parallel to one another and an expanded configuration wherein the link members define a circumferential hoop. The reflector surface is secured to the hoop assembly and collapses and extends therewith. Each hinge member attaches to both top and bottom portions of the mast so that in the end the load path goes from one end of the mast, to the hinge and to the other end of the mast using the cords. The cords maintain the hoop in a plane, therefore bending stiffness in the hoop is not required as in the hoop reflector. The hoop extends via torsion springs on the hinges which are biased to deploy the reflector. Additional cords attached from the collapsible mesh surface to the base of the mast are used to pull the mesh down into a parabolic surface, therefore the hoop is not required to have depth out of plane to form the reflector into a parabola.

In at least one embodiment, the invention provides a method of deploying a reflector of a reflector system comprising a housing, a hoop assembly positioned in the housing and comprising a plurality of link members extending between a plurality of hinge members, the hoop assembly moveable between a collapsed configuration wherein the link members extend substantially parallel to one another and an expanded configuration wherein the link members define a circumferential hoop; a collapsible mesh reflector surface secured to the hoop assembly such that when the hoop assembly is in the collapsed configuration, the reflector surface is collapsed within the hoop assembly and when the hoop assembly is in the expanded configuration, the reflector surface is expanded to a generally parabolic shape; and a mast assembly including an extendible mast, wherein each of the hinge members is secured by cords relative to a top portion of the mast and a bottom portion of the mast. The method includes extending the mast such that the biased hinges are free to expand the hoop assembly to the expanded configuration. In at least one embodiment, the mast is extended beyond a full deployment length which causes the cords to dampen the automatic expansion of the hoop assembly such that expansion is controlled. Thereafter, retracting the mast toward a full deployment position such that the hoop assembly fully expands to the expanded configuration in a controlled manner.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Figure 1:
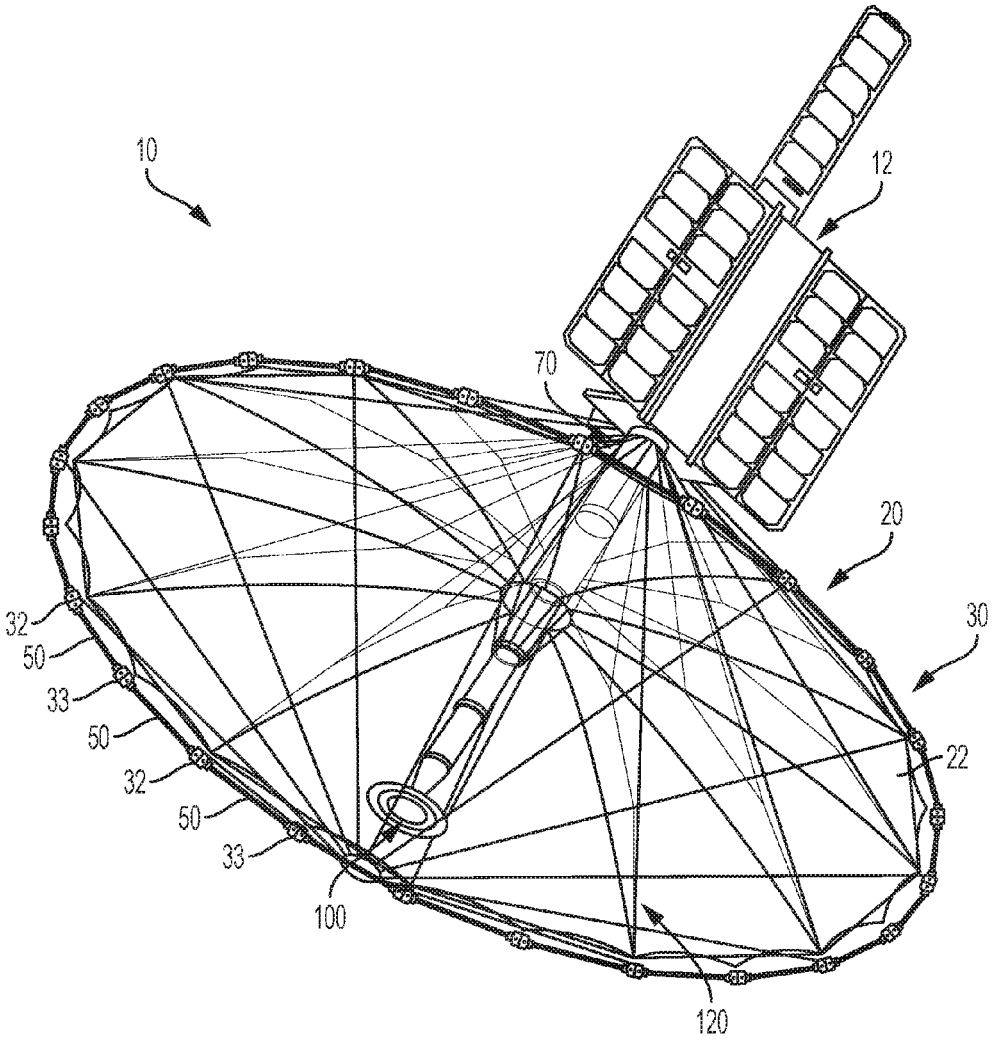
FIG. 1 is an isometric view of a deployable mesh reflector system in accordance with an embodiment of the invention.
Figure 2:
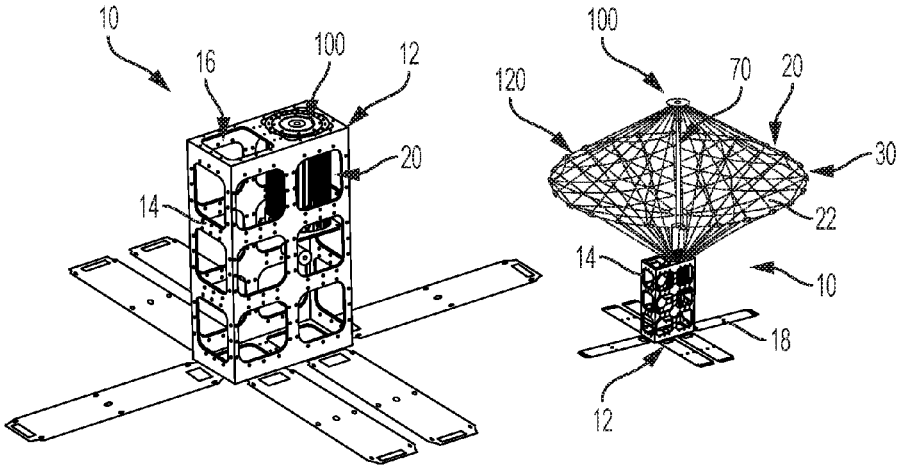
FIGS. 2 and 3 are isometric views of exemplary deployable mesh reflector systems illustrating differently sized systems in their respective stowed and deployed configurations.
Figure 3:
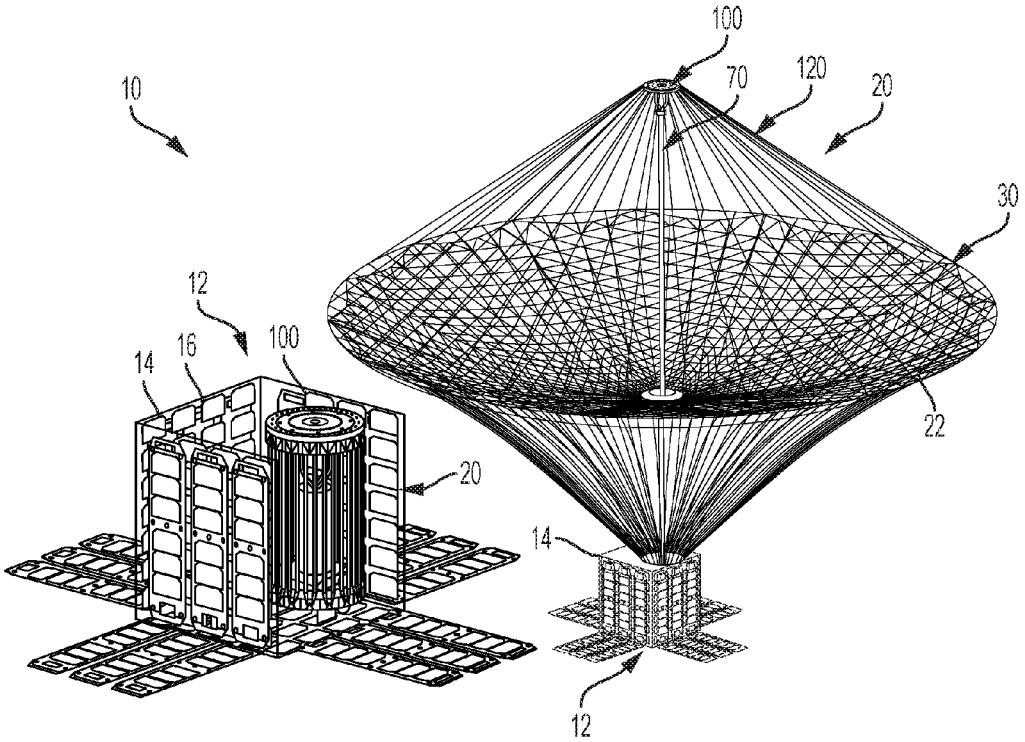
Figure 4:
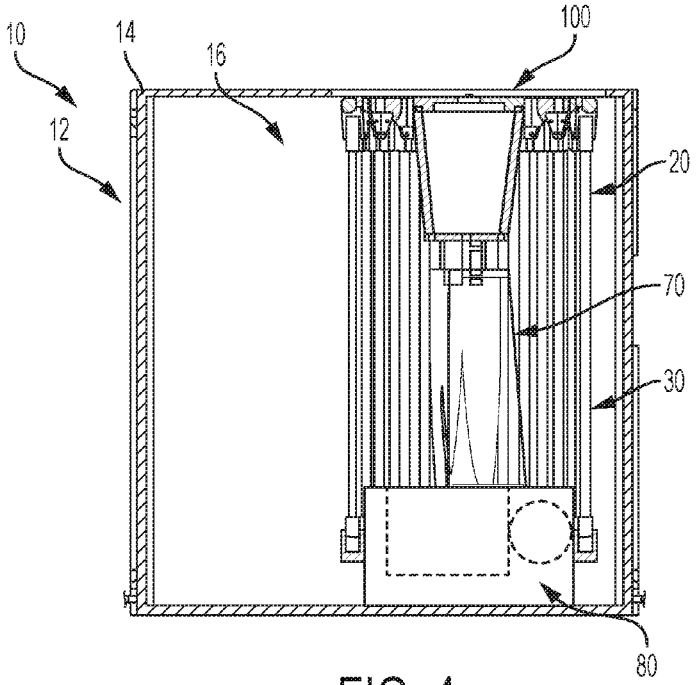
FIG. 4 is a side elevation view of an exemplary deployable mesh reflector stowed within a housing of the system.
Figure 5:
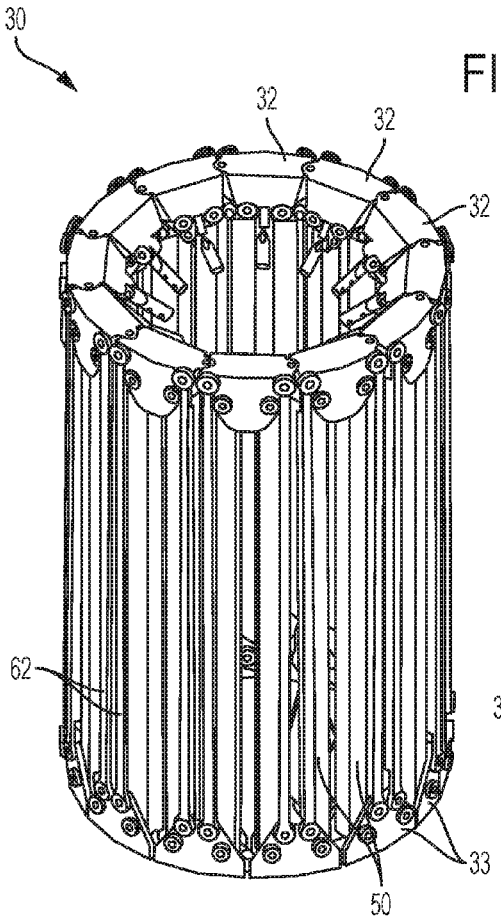
FIG. 5 is an isometric view of an exemplary hoop assembly in a stowed configuration.
Figure 6:
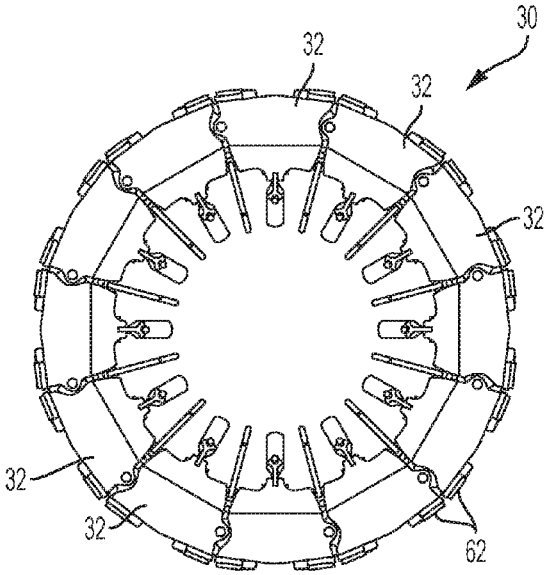
FIG. 6 is a top plan view of the hoop assembly of FIG. 5.
Figure 7:
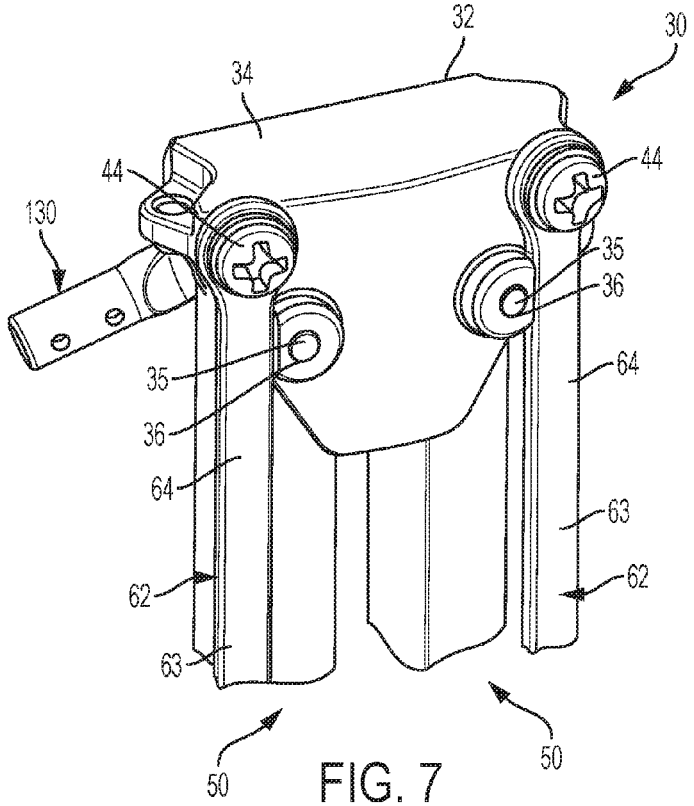
FIG. 7 is a front isometric view of an exemplary hinge assembly of the hoop assembly of FIG. 5.

Referring to FIGS. 1-4, a deployable mesh reflector system 10 in accordance with an exemplary embodiment of the invention will be described. The deployable mesh reflector system 10 generally comprises a housing or container 12 which is configured to stow a deployable mesh reflector 20. As illustrated in FIGS. 2 and 3, the housing 12 generally comprises a frame structure 14 which defines an interior space 16 for stowing of the deployable mesh reflector 20. As noted from FIGS. 2 and 3, the housing frame 14 may have various configurations and sizes depending on the size of the deployable mesh reflector 20. By way of example, the system 10 of FIG. 2 may include a deployable mesh reflector with a 1 meter aperture that is stowed within a housing 12 that is of 2 U cubes at packaging and having an approximately 10 cm×10 cm×20 cm volume while the system 10 of FIG. 3 may include a deployable mesh reflector with a 3 meter aperture that is stowed within a housing 12 that is of 12 U cubes at packaging and having an approximately 20 cm×20 cm×30 cm volume. In at least one embodiment, the housing 12 is in the nanosat or microsat range. As will be described in more detail hereinafter, the configuration of the hoop assembly 30 and the mast assembly 70 allow for a larger aperture reflector within a smaller volume than prior rib structures.

The deployable mesh reflector 20 generally comprises a collapsible, parabolic mesh reflector surface 22 which is supported by a circumferential hoop assembly 30. The hoop assembly 30 is supported by a mast assembly 70 via a plurality of cords 120. As illustrated in FIGS. 2 and 3, the hoop assembly 30 and the mast assembly 70 are configured to collapse into a stowed configuration which fits within the interior space 16 of the housing 12. An antenna feed assembly 100 is provided at the free end of the mast assembly 70. A top plate (not shown) closes off the housing 12 when in the stowed configuration. As described in more detail hereinafter, in addition to providing the feed function, the antenna feed assembly 100 also functions as part of the support system. A drive train assembly 80 positioned within the housing 12 is configured to extend the mast assembly 70 to deploy the reflector surface 22. As will be described in more detail hereinafter, in at least one embodiment, the hoop assembly 30 is configured to be self-deploying such that the deployed hoop structure is achieved without the need for additional motors or the like.

Referring to FIGS. 5-12, an exemplary hoop assembly 30 will be described. The hoop assembly 30 generally comprises a plurality of upper hinge members 32 which are interconnected with a plurality of lower hinge members 33 via link members 50. The upper and lower hinge members are circumferentially offset from one another such that a pair of adjacent link members 50 which are connected to one upper hinge member 32 are connected to two adjacent, but distinct lower hinge members 33. In this manner, upon deployment, the hoop assembly defines a continuous circumferential hoop structure with link members extending between alternating upper and lower hinge members (see FIG. 1). In the stowed configuration illustrated in FIGS. 5 and 6, the upper hinge members 32 collapse adjacent to one another and the lower hinge members 33 collapse adjacent to one another with the link members 50 extending therebetween in generally parallel alignment.

In the illustrated embodiment, the hoop assembly 30 includes twelve upper hinge members 32 and twelve lower hinge members 33 and twenty-four link members 50. The invention is not limited to such and the number of such components may be adjusted based on the desired stowed volume of the hoop assembly and the desired aperture of the reflector. The aperture size can be increased by increasing the length or number of the link members 50, each of which has a resultant exponential increase in the aperture area. The structure allows for a maximum deployable aperture size while stowing the antenna in a minimum volume.

Referring to FIGS. 7-12, the interconnection of the hinge members 32, 33 and the link members 50 and the operation thereof will be described in more detail. While FIGS. 7-11 are described with respect to an upper hinge member 32, it is understood that the lower hinge members 33 have the same construction and operate in a similar manner. Each hinge member 32 includes a body 34 defining an interior chamber 35 (see FIG. 10) configured to receive the heads 56 of two link members 50 and to allow rotation of the link members 50 from the stowed configuration illustrated in FIG. 10 to the deployed configuration illustrated in FIG. 11. Each hinge member body 34 also supports a plurality of cord connectors 130 and sync rods 62, as will be described in more detail hereinafter.

Figure 9:
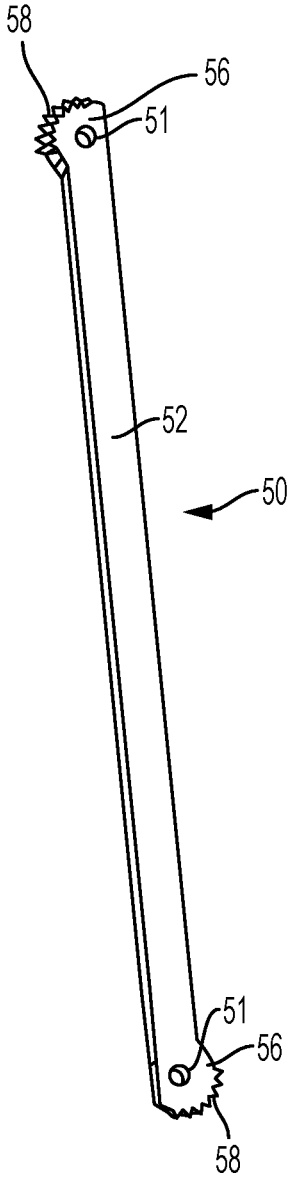
FIG. 9 is an isometric view of an exemplary gear link member of the hoop assembly of FIG. 5.

Referring to FIG. 9, each link member 50 includes a linear rod 52 extending between opposed heads 56. The rods 52 are preferably manufactured from light weight, high strength materials, for example, carbon fiber. The heads 56 include gear teeth 58 and are preferably manufactured from a harder material, for example, Titanium. The invention is not limited to the identified materials and other materials may be utilized. The heads 56 are positioned such that on opposite ends of the link member 50, the gear teeth 58 face in opposite directions, thereby allowing one end to engage within an upper hinge 32 and the other end to engage with an offset lower hinge 33. Each head 56 includes a cross through bore 51 extending there through which is configured to receive a screw 35 or the like to pivotally connect the head 56 to the hinge body 34 at a pivot point 36.

Figure 10:
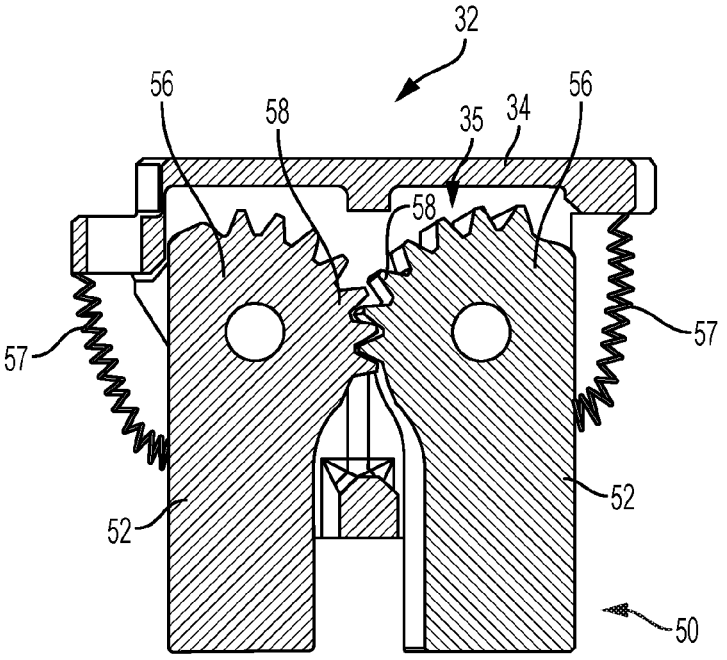
FIG. 10 is a cross-sectional view of a hinge assembly illustrating the gear link members in a stowed configuration.
Figure 11:
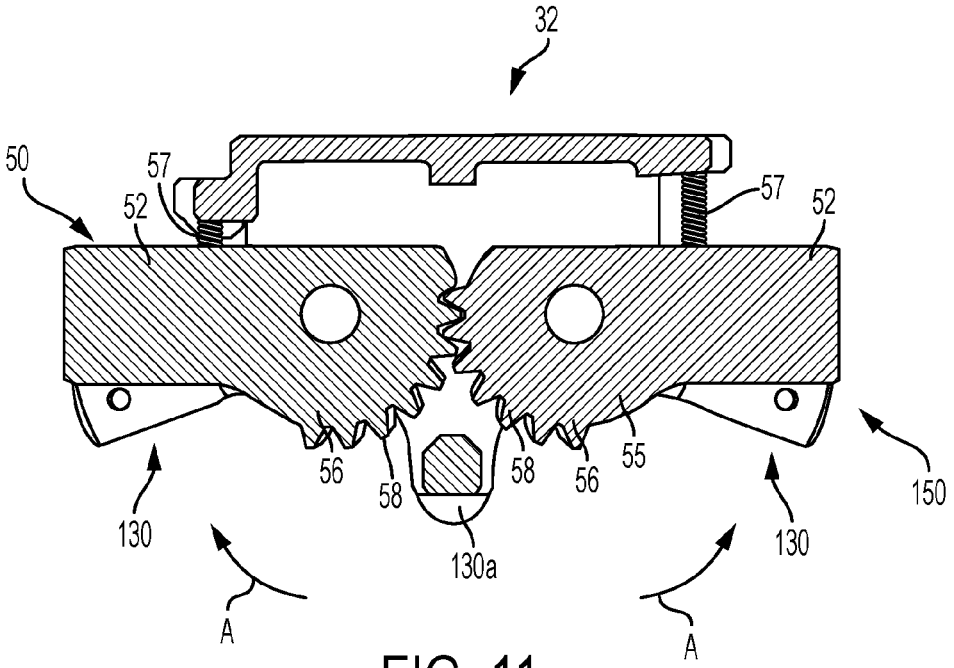
FIG. 11 is a cross-sectional view similar to FIG. 10 illustrating the gear link members in a deployed configuration.

Referring to FIG. 10, an extended spring 57 or the like extends between the rod 52 and the hinge body 34 and urges the respective link member 50 to the deployed configuration as illustrated in FIG. 11. A hoop damping system may be provided internal to the link members 50 to assist with a controlled deployment.

Figure 8:
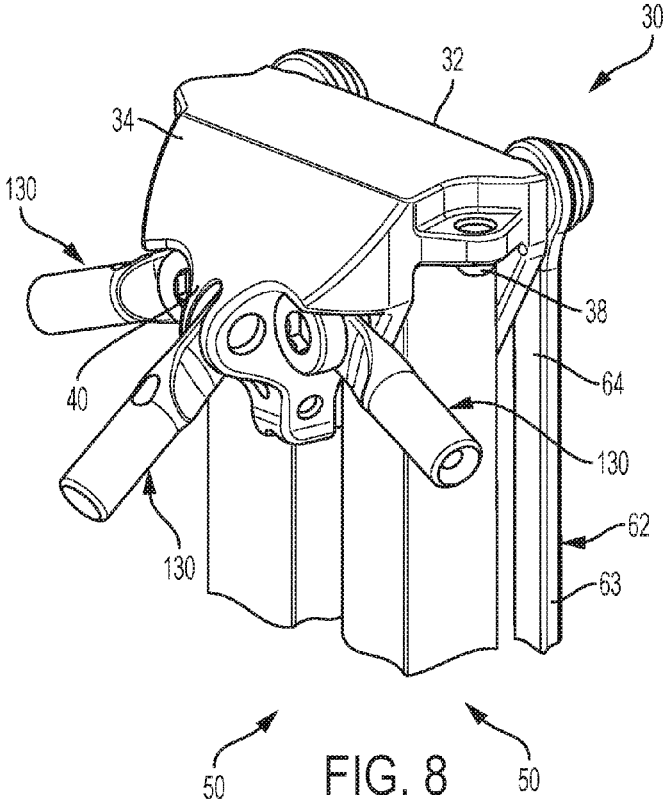
FIG. 8 is a rear isometric view of the hinge assembly of FIG. 7.

Each hinge member 32, 33 includes a plurality of cord connectors 130 pivotally connected to the body 34, for example, at pivot point 40 (see FIG. 8). Each cord connector 130 is configured for attachment to a cord 120 which in turn may either connect to a top portion of the mast assembly 70, a bottom portion of the mast assembly 70 or to the reflector surface 22 to deploy and shape the reflector surface 22, as described hereinafter. Preferably, each of the hinge members 32, 33 is connected to both the top and bottom portions of the mast assembly 70 and to the reflector surface 22, although it is possible that only a subset of the hinge members 32, 33 are connected to the top portion of the mast assembly 70 and the remaining subset of the hinge members 32, 33 are connected to the bottom portion of the mast assembly 70. In each configuration, the load path goes from one end of the mast 76, to the hinges 32, 33 of the hoop assembly 30 and to the other end of the mast using the cords 120.

Referring to FIG. 11, as explained above, the springs 57 are configured to urge the gear link members 50 toward the deployed positioned as indicated by arrows A. As such, upon release of the hoop assembly 30 from the housing 12, for example via extension of the mast assembly or via a slide assembly, the springs 57 cause the hoop assembly 30, and thereby the reflector 22, to automatically deploy. Engagement of the gear teeth 58 ensures that adjacent link members 50 rotate in unison with one another for a smooth deployment of the hoop structure. A stop 38 may be defined on the hinge body 34 to define a maximum rotation of the gear link members 50.

Figure 12:
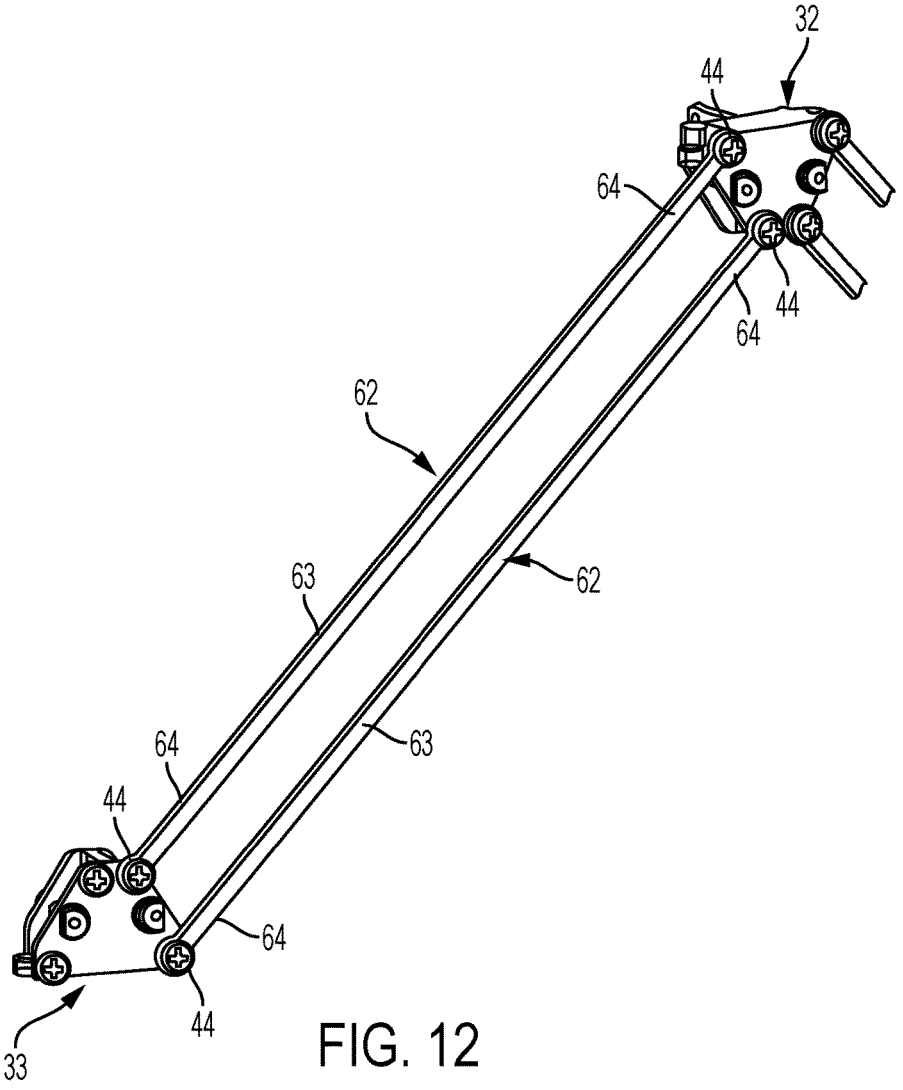
FIG. 12 is an isometric view of a pair of hinge assemblies interconnected by sync rods in a partially deployed configuration.
Figure 13:
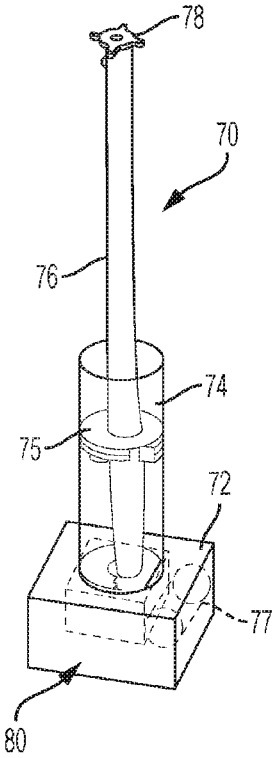
FIG. 13 is an isometric view of an exemplary mast assembly in a deployed configuration.
Figure 14:
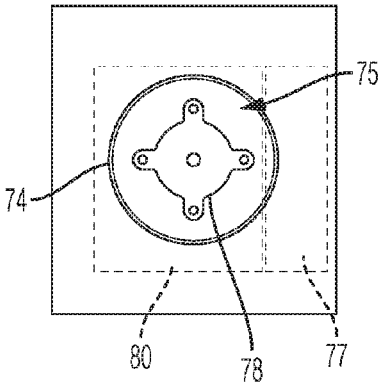
FIG. 14 is a top plan view of the mast assembly of FIG. 13.
Figure 15:
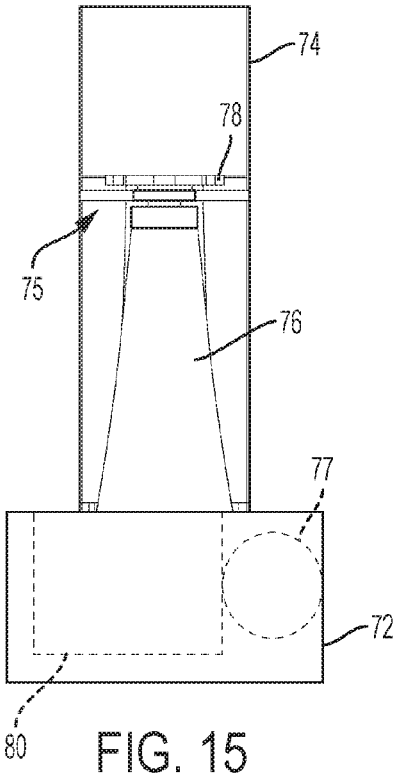
FIGS. 15 and 16 are front and side elevation views of the mast assembly of FIG. 13 in a stowed configuration.
Figure 16:
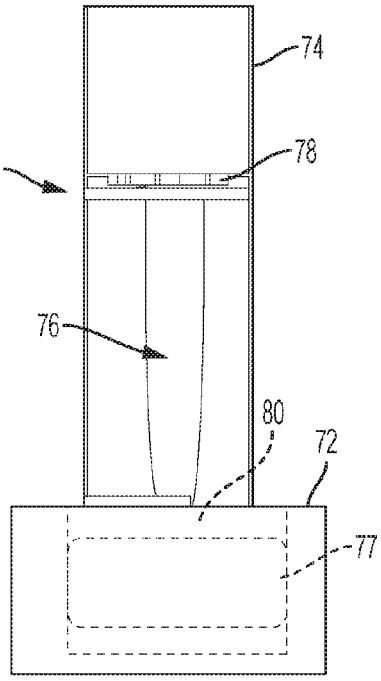

To further assist with a synchronous deployment of the hoop structure, sync rods 62 may be secured to the hinge members 32, 33 in an offset manner similar to the link members 50. Referring to FIG. 12, each sync rod 62 includes a rod 63 extending between opposed ends 64. Each end 64 is configured to be pivotally connected to a respective hinge body 34 at a pivot point 44. The sync rods 62 are preferably manufactured from light weight, high strength materials, for example, carbon fiber and the ends 64 may be manufactured from a harder material, for example, Titanium. A single sync rod 62 may extend between each connected upper and lower hinge member 32, 33 (see FIG. 7) or a pair of sync rods 62 may extend between each connected upper and lower hinge member 32, 33 (see FIG. 12). As the hinge members 32, 33 are moved apart and the link members 50 pivot, the sync rods 62 maintain the rotation angle between adjacent hinge members 32, 33 for synchronous deployment. Exemplary deployment sequences will be described hereinafter.

Referring to FIGS. 13-17, an exemplary mast assembly 70 will be described. Generally, the mast assembly 70 includes an extendable boom 76 with an antenna feed assembly 100 secured to a support plate 78 at a free end thereof. With specific reference to FIGS. 13-16, the mast 76 of the present embodiment is a split-tube type boom which is stored on a spool 77 within a housing 72 and extended through a shoot 74. Slit-tube booms can have two configurations. A first configuration can include a stowed configuration (see FIGS. 15 and 16). A second configuration can include a deployed configuration (see FIG. 13). In the stowed configuration, the slit-tube boom can flatten laterally and be rolled longitudinally. In the deployed configuration, the slit-tube boom can be extended longitudinally and rolled or curved laterally. A drive train assembly 80 within the housing 72 is configured to extend the split tube boom 76 for deployment. While a split type boom is described with respect to the present embodiment, the invention is not limited to such and the mast 76 may have other configurations, for example, a rolled boom with a lenticular or open triangular cross section, or a pantograph configuration. As a further example, the mast assembly may include a plurality of links joined by hinges which is moveable between a collapsed configuration wherein the link members extend substantially parallel to one another and an expanded configuration wherein the link members align co-linear to one other. As another example, the extendible mast assembly may include a plurality of links that slide relative to one another such that the mast assembly automatically extends from a collapsed configuration where the links are nested together and an expanded configuration wherein the link members extend substantially end to end.

Figure 17:
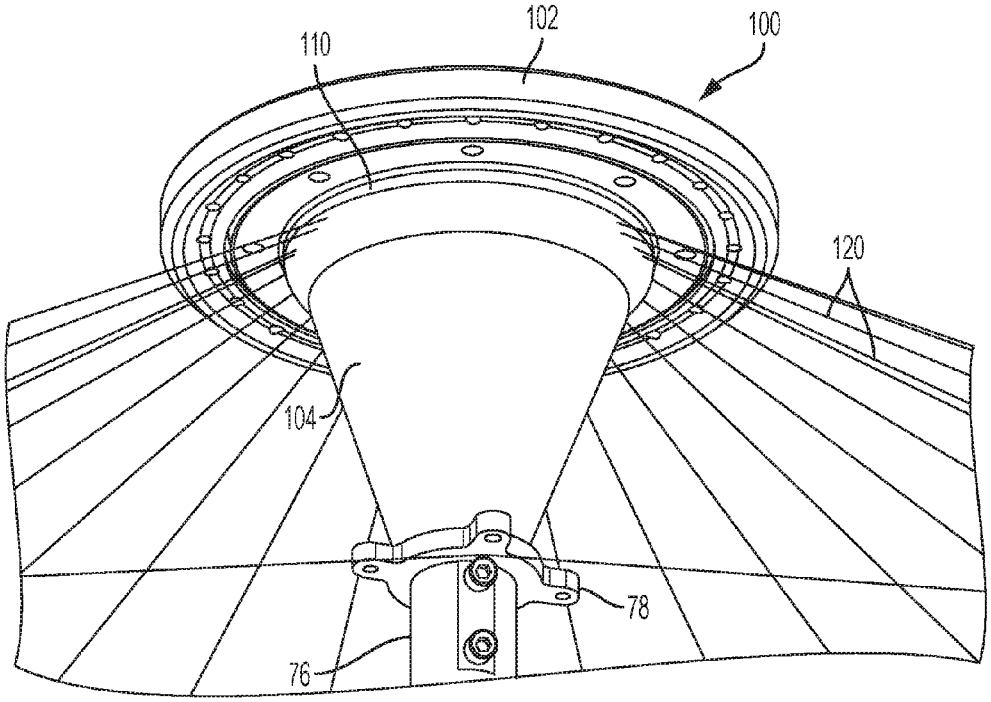
FIG. 17 is an expanded isometric view of the antenna feed assembly atop the mast assembly.

Referring to FIG. 17, an antenna feed assembly 100 which is connected to the support plate 78 and defines a part of the mast assembly 70 will be described. A support structure 104 extends between the support plate 78 and the antenna feed assembly 100. The antenna feed assembly 100 includes an antenna feed plate 102 which is configured to function as an antenna feed in a known manner. Additionally, an upper cord plate 110 is secured to an underside of the antenna feed plate 102 and is configured for connection of the cords 120 which extend from the cord connectors 130.

Figure 18:
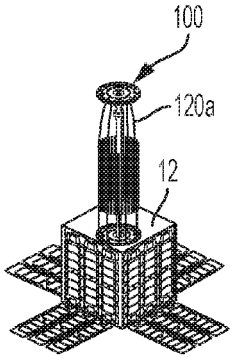
FIGS. 18-24 are isometric views illustrating an exemplary deployment sequence of a deployable mesh reflector system in accordance with an embodiment of the invention.
Figure 19:
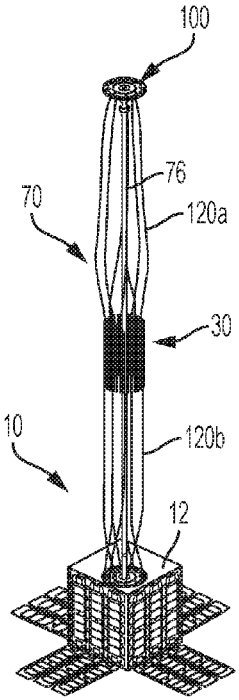
Figure 20:
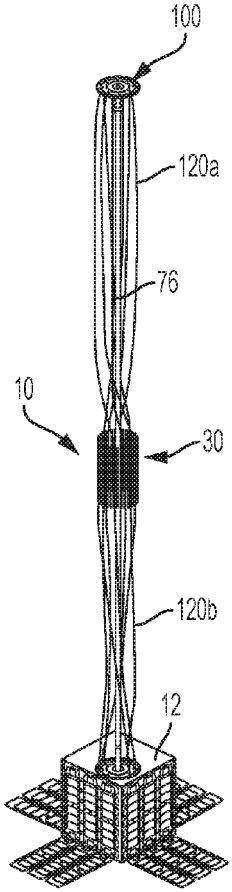
Figure 21:
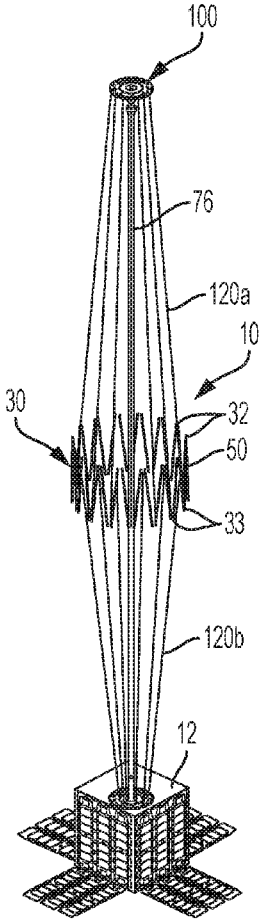
Figure 22:
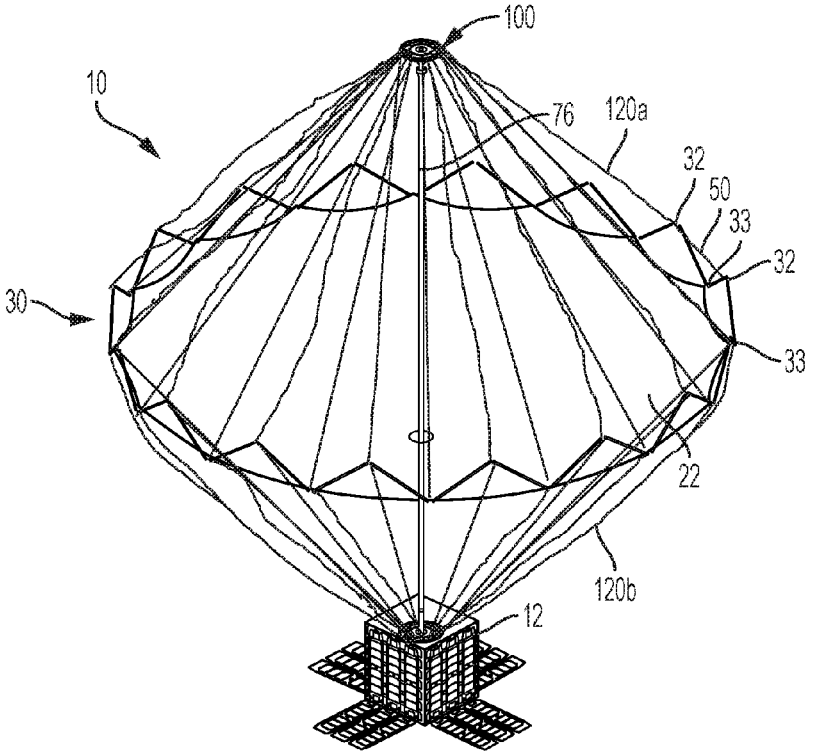
Figure 23:
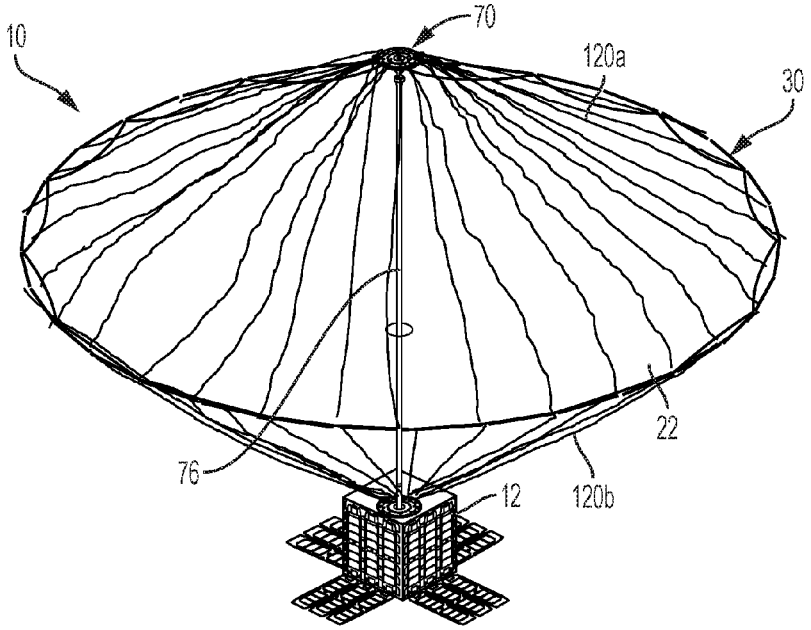
Figure 24:
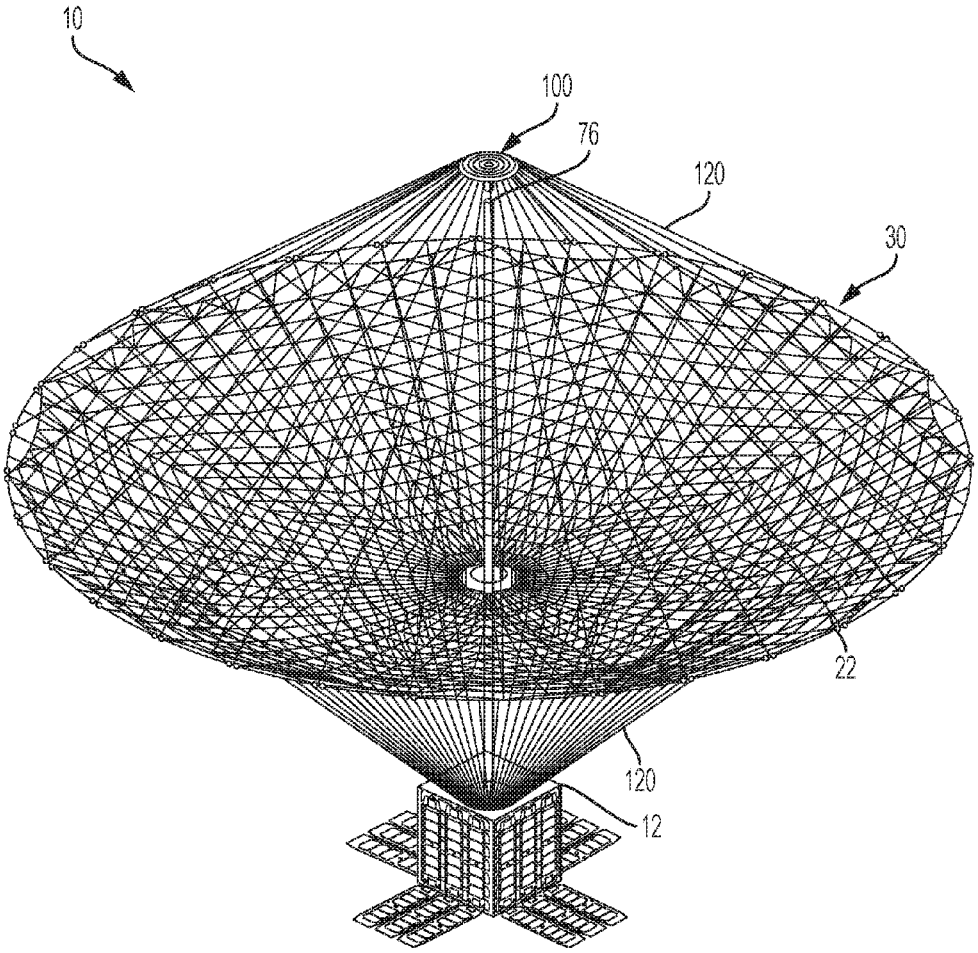
Figure 25A:
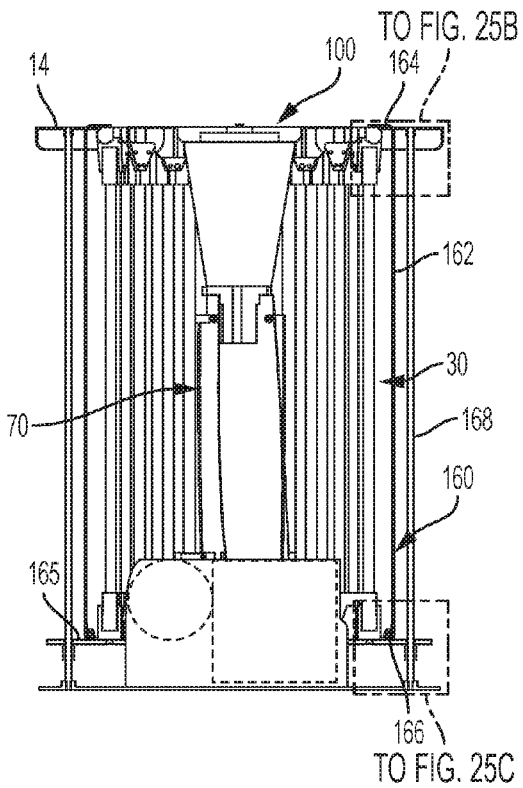
FIG. 25A is a side elevation view of a hoop assembly positioned with respect to a slide assembly in accordance with an embodiment of the invention, with partial expanded views shown in FIGS. 25B and 25C as indicated.
Figure 25B:
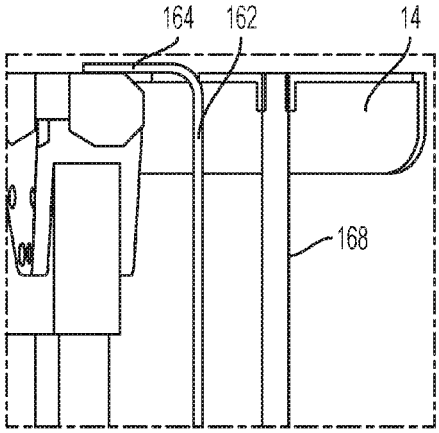
Figure 25C:
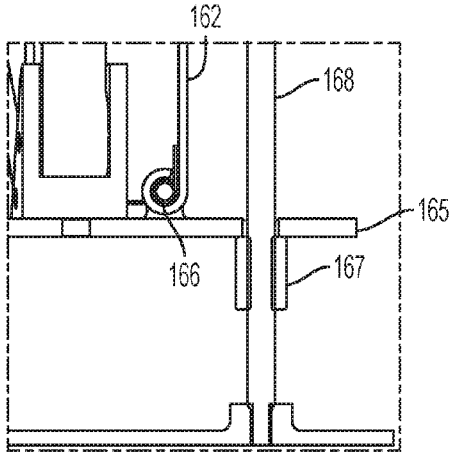
Figure 26:
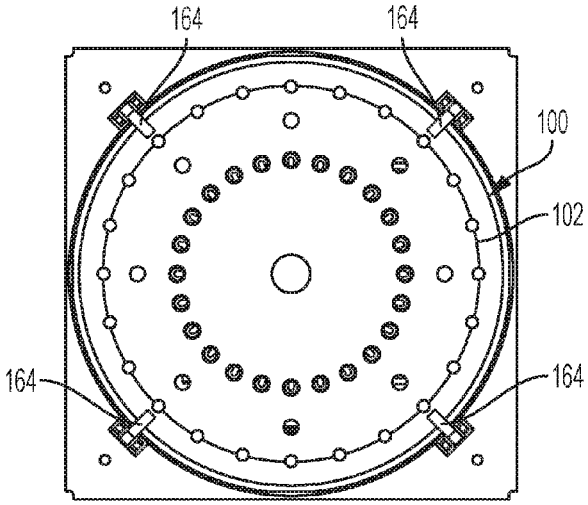
FIG. 26 is a top elevation view of the hoop assembly and slide assembly of FIG. 25A.
Figure 27:
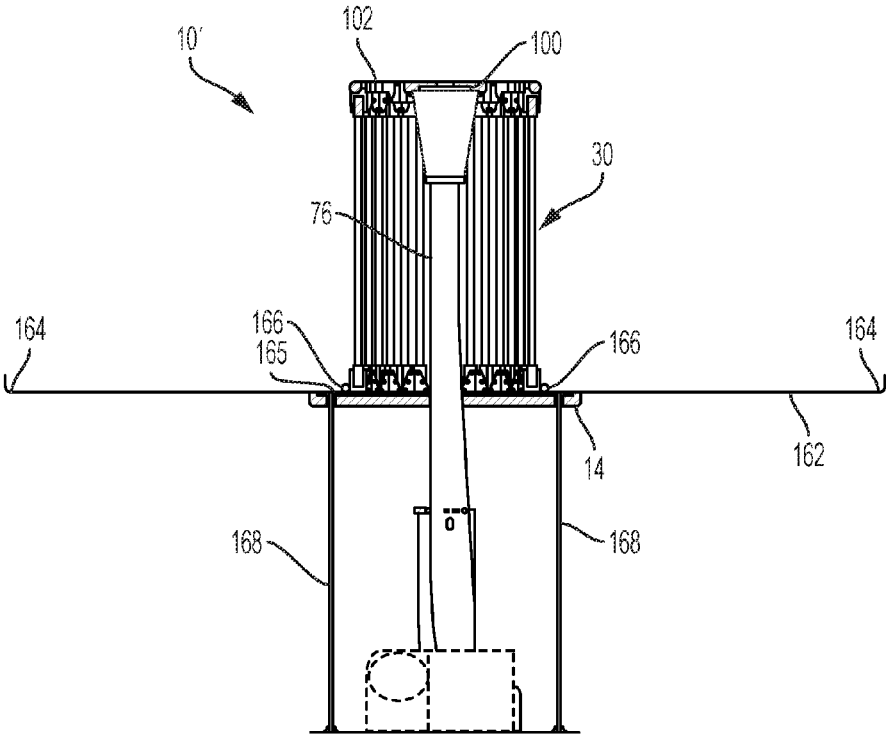
FIG. 27 is a side elevation view illustrating actuation of the slide assembly.

Having described the components of an exemplary deployable mesh reflector system 10, an exemplary deployment sequence thereof will be described with reference to FIGS. 18-24. Referring to FIG. 18, the drive train assembly 80 (not shown) is activated such that the mast 76 is extended and the cords 120*a* are released from the housing 12. As the mast 76 continues to extend as illustrated in FIG. 19, the hoop assembly 30 moves therewith, supported between the cords 120*a, b*. As the hoop assembly 30 is released from the housing 12, the cords 120*b* are released. The mast 76 continues to extend beyond its normal deployed position, for example, to about 150% deployment, as illustrated in FIG. 20. As the cords 120*a* and 120*b* are tensioned, the hoop assembly 30 is released and the springs 57 of the hinges 32, 33 begin to automatically deploy the hoop assembly 30 as illustrated in FIG. 21. The cords 120*a* and 120*b* connected between hoop 30 and the top or bottom portion of the mast 76 stall the automatic deployment of the hoop 30 because of the extension beyond the normal deployed position. Thereafter, the mast 76 is retracted as illustrated in FIG. 22 such that the hoop assembly 30 expands in a controlled manner and the reflector surface 22 is expanded therewith. As illustrated in FIG. 23, the mast 76 may be retracted to less than the fully deployed length to allow the hoop assembly 30 to deploy over-center, however, such may not be required. Finally, as illustrated in FIG. 24, the mast 76 is extended to the normal deployed position and the reflector system 10 is in an operational deployed configuration. Collapsing of the hoop assembly 30 for stowing may be done manually by pivoting the link members 50 to the stowed configuration as the mast assembly 70 is lowered.

Referring to FIGS. 25A-28, a deployable mesh reflector system 10' incorporating a push-out mechanism 160 will be described. The push-out mechanism 160 is configured such that the hoop assembly 30 remains engaged with the antenna feed assembly 100 during initial deployment of the mast 76. The push-out mechanism 160 includes a plate 165 upon which the hoop assembly 30 is supported. The plate 165 is guided for movement relative to the housing frame 14 via a plurality of rails 168. Guide bushings 167 or the like extend from the plate 165 and move along the rails 168. To prevent the antenna feed assembly 100 from moving away from the hoop assembly 30, a plurality restraint members 162 extend from a biased, pivot connection 166 at the plate 165 to a latch member 164 which extends about the antenna feed plate 102. Referring to FIG. 29, when the mast 76 is deployed, the restraint members 162 ensure that the hoop assembly 30 and antenna feed assembly 100 move together until the hoop assembly 30 is beyond the housing frame 14, at which point the plate 165 stops moving and the restraint members 162 are forced to disengage the antenna feed plate 102 as the mast 76 continues to extend. While a latch push-out mechanism is illustrated, other mechanisms, for example, magnets, ball detents and the like, may be utilized to prevent deployment until the hoop assembly 30 is beyond the housing frame 14.

Figure 28:
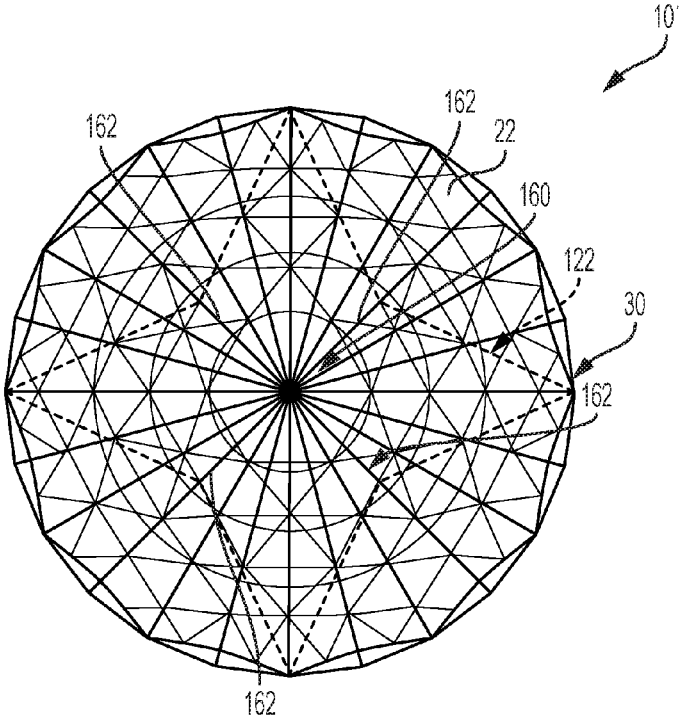
FIG. 28 is a top plan view of an exemplary mesh reflector system incorporating the slide mechanism of FIGS. 25A-27.
Figure 29:
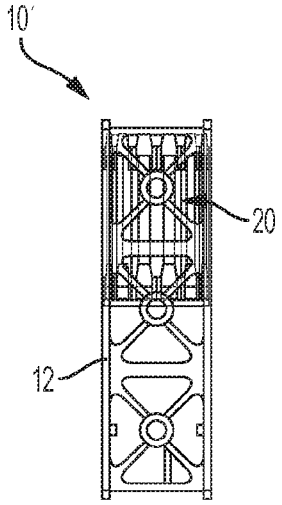
FIGS. 29-33 are isometric views illustrating another exemplary deployment sequence of a deployable mesh reflector system in accordance with an embodiment of the invention.

Referring to FIG. 28, the reflector system 10 is illustrated with a torsion cord 122 which provides additional torsional stiffness to the reflector 22. The torsion cord 122 extends between the hoop assembly 30 and a portion of the housing (not shown) or, as in the illustrated embodiment, a portion of the slide mechanism 160. In the illustrated embodiment, upon deployment, the torsion cord 122 extends from the hoop assembly 30 to the restraint members 162 which serve as torsion arms. The torsion cord 122 may additionally or alternatively engage the housing frame 14 or the like.

Figure 30:
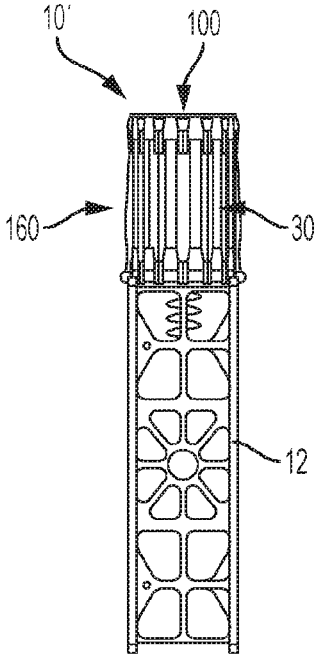
Figure 31:
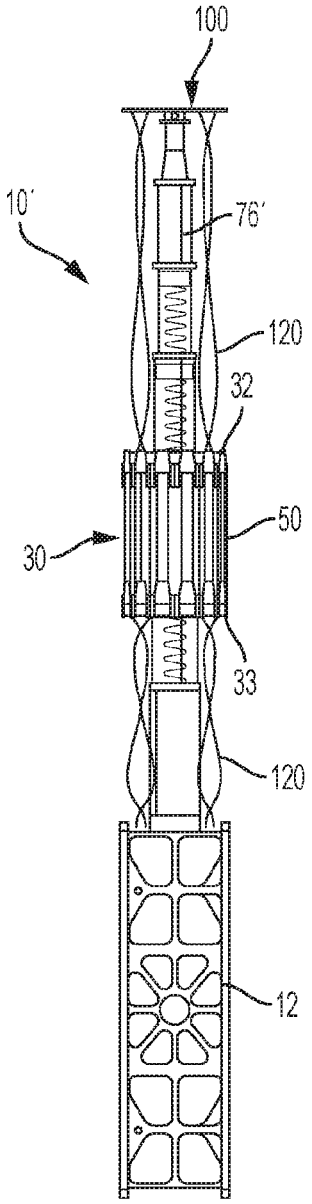
Figure 32:
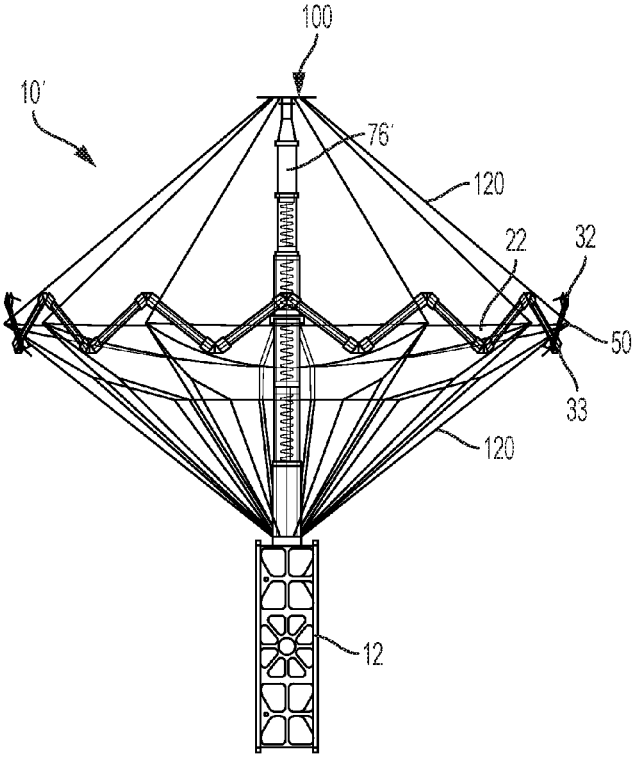
Figure 33:
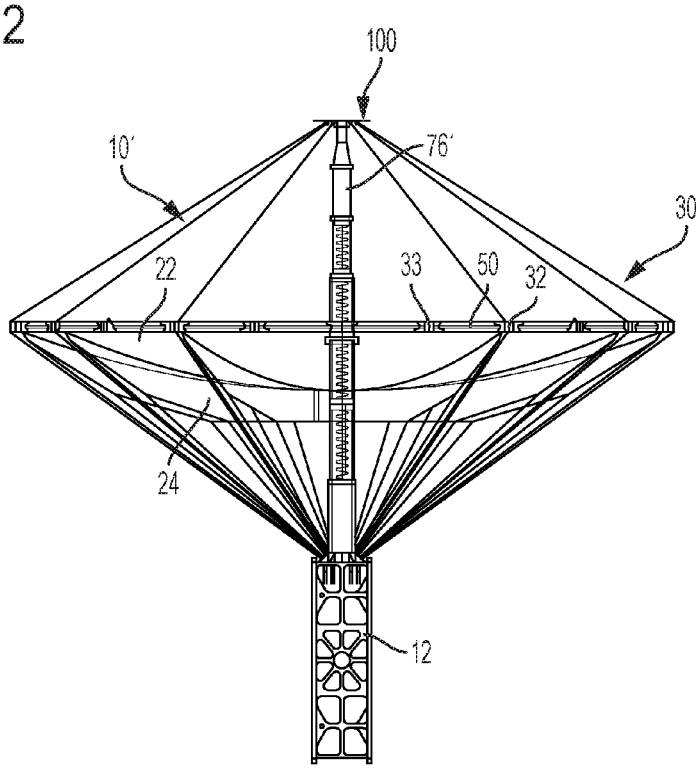

Referring to FIGS. 29-33, an alternative deployment sequence will be described. With reference to FIG. 29, the deployable mesh reflector 20 is in the stowed configuration within the housing 12. In FIG. 30, the hoop assembly 30 and antenna feed assembly 100 have been extended together via the slide mechanism 160. As the mast 76' continues to extend as illustrated in FIG. 31, the hoop assembly 30 moves therewith, supported between the cords 120, and the springs of the hinges 32, 33 begin to cause the link members 50 to pivot and deploy. In FIG. 32, the mast 76' may be extended beyond the normal deployed position such that cord tension on the upper and lower hinge members 32, 33 helps to avoid overly rapid deployment similar to the previous embodiment. Thereafter, the mast 76' is retracted as illustrated in FIG. 33 such that the hoop assembly 30 expands in a controlled manner and the reflector surface 22 is expanded therewith until the reflector system 10' is in an operational deployed configuration. It is noted in FIG. 33, that the reflector surface may include additional features, for example, a radial fin support film 24, extending generally perpendicular to the reflector surface 22, to provide additional support.

The deployable mesh reflector systems 10, 10' described herein produce the maximum deployable aperture size, while stowing the antenna in a minimum volume.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A reflector system, comprising:

a hoop assembly comprising a plurality of link members extending between a plurality of hinge members, the hoop assembly configured to automatically, passively expand between a collapsed configuration wherein the link members extend substantially parallel to one another and an expanded configuration wherein the link members define a circumferential hoop;

a collapsible mesh reflector surface secured to the hoop assembly with a plurality of cords such that when the hoop assembly is in the collapsed configuration, the reflector surface is collapsed within the hoop assembly and when the hoop assembly is in the expanded configuration, the reflector surface is expanded to a shape that is intended to concentrate RF energy in a desired pattern; and a mast assembly including an extendible boom, wherein the hoop assembly is secured by a plurality of cords relative to a top portion of the boom and to a bottom portion of the boom such that upon extension of the boom to a deployed condition, the hoop assembly is supported by the boom.

2. The reflector system according to claim 1 wherein each of the link members in the hoop is biased toward the deployed configuration with a spring member.

3. The reflector system according to claim 2 wherein the link members include an internal damping system to assist with controlled deployment of the hoop assembly.

4. The reflector system according to claim 1 wherein gears on the end of adjacent link members engage at the hinge and are configured to synchronize the rotation angle between adjacent link members for synchronous deployment.

5. The reflector system according to claim 1 wherein sync rods extend between adjacent hinge members and are configured to maintain the rotation angle between adjacent hinge members for synchronous deployment.

6. The reflector system according to claim 1 wherein the top portion of the boom supports an antenna feed plate.

7. The reflector system according to claim 6 wherein the antenna feed plate is interchangeable without affecting the mesh reflector surface.

8. The reflector system according to claim 1 wherein each section of the hoop assembly includes a pair of link members hinged in the middle that rotate in opposite directions and are connected to the next pair on each end such that the entire hoop moves synchronously.

9. The reflector system according to claim 1 wherein the extendible mast assembly is comprised of a plurality of links joined by hinges, the mast assembly moveable between a collapsed configuration wherein the link members extend substantially parallel to one another and an expanded configuration wherein the link members align substantially to each other.

10. The reflector system according to claim 1 wherein the extendible mast assembly is comprised of a plurality of links that slide relative to one another, such that the mast assembly automatically extends from a collapsed configuration where the links are nested together and an expanded configuration wherein the link members extend substantially end to end.

11. A reflector system, comprising:

a hoop assembly comprising a plurality of link members extending between a plurality of hinge members, the hoop assembly moveable between a collapsed configuration wherein the link members extend substantially parallel to one another and an expanded configuration wherein the link members define a circumferential hoop;

a collapsible mesh reflector surface secured to the hoop assembly with a plurality of cords such that when the hoop assembly is in the collapsed configuration, the reflector surface is collapsed within the hoop assembly and when the hoop assembly is in the expanded configuration, the reflector surface is expanded to a shape that is intended to concentrate RF energy in a desired pattern; and a mast assembly comprising an elongate, extendible mast configured to be coiled around a spool, wherein the hoop is secured by a plurality of cords to the distal end of the mast and to the base of the mast, such that when the mast is fully extended the tensioned cords maintain the shape of the hoop.

12. The reflector system according to claim 11 wherein the mast is an extendible hollow member with a slit running longitudinally along the length that can be flattened laterally and rolled about an axis transverse to the slit.

13. The reflector system according to claim 11 wherein the mast is an extendible member with an open substantially triangular cross section formed from two curved flanges attached at their upper portions when deployed and stowed with a flattened cross-section about a circular hub.

14. The reflector system according to claim 11 wherein the mast is an extendible member formed of a pair of mated strips of thin spring material joined at margins and curved in cross section outwardly and oppositely so that when the mast is flattened and rolled into a coil, the margins and curved portions lie juxtaposed.

15. A reflector system, comprising:

a hoop assembly comprising a plurality of link members extending between a plurality of hinge members, the hoop assembly automatically expands between a collapsed configuration wherein the link members extend substantially parallel to one another and an expanded configuration wherein the link members define a circumferential hoop;

a collapsible mesh reflector surface secured to the hoop assembly with a plurality of cords such that when the hoop assembly is in the collapsed configuration, the reflector surface is collapsed within the hoop assembly and when the hoop assembly is in the expanded configuration, the reflector surface is expanded to a shape that is intended to concentrate RF energy in a desired pattern;

a mast assembly including an extendible mast, wherein the hoop assembly is secured by a plurality of cords relative to a top portion of the mast and to a bottom portion of the mast such that upon extension of the mast to a deployed condition, the hoop assembly is supported by the mast; and a housing in which the hoop assembly, reflector surface and mast assembly are stowed prior to deployment.

16. The reflector system according to claim 15 further comprising a slide mechanism such that the hoop assembly is pushed from the housing prior to full deployment of the mast.

17. The reflector system according to claim 16 wherein at least a portion of the cords secured relative to a bottom portion of the mast are attached to the slide mechanism.

18. The reflector system according to claim 16 further comprising moveable members attached to the slide mechanism having a stowed position that constrain the slide mechanism to move with the hoop assembly and having a deployed position that releases the hoop assembly from the slide when the slide mechanism is fully deployed.

19. The reflector system according to claim 18 wherein cords from the hoop assembly are attached to the moveable members such that hoop is stabilized in the fully deployed position by the moveable members.

20. The reflector system according to claim 16 wherein the slide mechanism is moved by tension in the cords.

21. The reflector system according to claim 16 where a plurality of the cords that shape the collapsible mesh reflector are connected to the slide mechanism.

22. The reflector system according to claim 15 where a plurality of the cords that shape the collapsible mesh reflector are connected to the housing.

23. The reflector system according to claim 15 where a plurality of the cords that shape the collapsible mesh reflector are connected to cords that extend from the hoop assembly to the housing.

24. The reflector system according to claim 15 where in the stowed condition, the hoop assembly is secured in the housing by a plate at the end of the mast that is used to secure cords extending from the hoop assembly.

25. The reflector system according to claim 24 wherein the plate is used to mount the antenna feed assembly.

26. The reflector system according to claim 25 wherein the antenna feed assembly is interchangeable without affecting the mesh reflector surface.

27. The reflector system according to claim 25 where the plate is used as a ground plane or reflective surface of the antenna feed assembly.

28. The reflector system according to claim 15 wherein the housing is in the nanosat or small satellite range (1-500 kg).

29. A method of deploying a reflector of a reflector system comprising a housing, a hoop assembly positioned in the housing and comprising a plurality of link members extending between a plurality of hinge members, the hoop assembly biased to move from a collapsed configuration wherein the link members extend substantially parallel to one another to an expanded configuration wherein the link members define a circumferential hoop; a collapsible mesh reflector surface secured to the hoop assembly such that when the hoop assembly is in the collapsed configuration, the reflector surface is collapsed within the hoop assembly and when the hoop assembly is in the expanded configuration, the reflector surface is expanded to a shape that is intended to concentrate RF energy in a desired pattern; and a mast assembly including an extendible mast, wherein the hinge members are secured by cords relative to a top portion of the mast and a bottom portion of the mast, the method comprising:

extending the mast beyond a full deployment length such that a cord tension between the hinges and the mast facilitates a controlled deployment of the hoop assembly; and retracting the mast toward the full deployment such that the hoop assembly fully expands to the expanded configuration in a controlled manner.

30. The method according to claim 29, further comprising the step of retracting the mast to a length less than the full deployed length such that the hoop assembly is allowed to fully deploy to an over-center condition and thereafter extending the mast again to tension the cords and apply compression to the hoop to create the final surface shape.

31. The method according to claim 29, further comprising the step of pushing the hoop assembly out of the housing prior to fully deploying the mast.

* * * * *